US005579288A

United States Patent [19]

Malloy et al.

[11] Patent Number: 5,579,288

[45] Date of Patent: Nov. 26, 1996

[54] WRISTWATCH DISPLAY PACKAGE

[75] Inventors: James B. Malloy, West Hartford; Charles G. Barrett, Groton, both of Conn.

[73] Assignee: Timex Corporation, Middlebury, Conn.

[21] Appl. No.: 342,492

[22] Filed: Nov. 21, 1994

[51] Int. Cl.[6] ..... B65D 43/24

[52] U.S. Cl. ..... 368/10; 368/281; 206/526; 206/459.5; 206/18

[58] Field of Search ..... 206/301, 18, 19, 206/45.18, 45.19, 6.1; 368/281, 282, 316, 317, 283, 10

[56] References Cited

U.S. PATENT DOCUMENTS 1,909,020 5/1933 Shields ..... 206/301
2,178,652 11/1939 Shields ..... 206/301
4,216,858 8/1980 Beauchamp ..... 84/484
4,498,589 2/1985 Scott et al. ..... 206/45.18
5,377,822 1/1995 Herzog ..... 201/301

*Primary Examiner*—Bernard Roskoski
*Attorney, Agent, or Firm*—William C. Crutcher

[57] ABSTRACT

A wristwatch display package is made using two elongated sheet members of transparent plastic joined end-to-end by a flexible hinge. The sheets are folded together, nested and sealed together around the peripheral edges. An elongated display card having printing thereon is disposed between the sheet members and within the sealed peripheral edges. The card has a window for displaying a portion of a wristwatch. The sheet members have protrusions which together form an arcuate cavity. The arcuate cavity is surrounded by the window in the display card and adapted to receive a wristwatch.

5 Claims, 2 Drawing Sheets

WRISTWATCH DISPLAY PACKAGE

BACKGROUND OF THE INVENTION

This invention relates generally to retail display packaging and more particularly to an improved package for display of a wristwatch. Wristwatches are generally displayed in individual packages which are designed to hang from display racks or which are designed to sit inside display counters in individual boxes or packages. The display packages are usually arranged to protect the wristwatches during transport and to carry the necessary instruction booklets, warranty cards and advertising material. The packaging usually includes cards or labels having an explanation of the product, country of origin, bar codes, trademark and other information visible to the prospective purchaser.

The packaging designed to hold and protect the wristwatch often makes it difficult for the prospective purchaser to visualize the product on his or her wrist. Opening the package to allow the consumer to hold the wristwatch against the wrist for further examination is not in the best interest of the manufacturer or retail store and sometimes floor samples are not available for this purpose.

Accordingly, it would be desirable to have a wristwatch display package which would allow the display of the product while still providing copy area to print information concerning benefits and operation of the product. It would also be desirable to have a wristwatch packaging display as outlined above which is adaptable for use in either countertop displays or in hanging rack displays.

Accordingly, one object of the present invention is to provide an improved wristwatch display package which allows display of the product so as to simulate use on the consumer's wrist.

Another object of the invention is to provide an improved wristwatch display package which allows display of the product while still providing copy area visible to the prospective purchaser.

Still another object of the invention is to provide an improved wristwatch display package with an economical design, usable either for countertop display cases or for hanging rack display of the product.

SUMMARY OF THE INVENTION

Briefly stated, the invention comprises a wristwatch display package comprising first and second elongated sheet members of transparent plastic adapted to be nested and sealed together around the peripheral edges thereof, an elongated display card having printing thereon disposed between said sheet members and within the sealed peripheral edges, the card defining a window for displaying a portion of a wristwatch through the transparent plastic, the first sheet member defining an arcuate elongated protrusion, the second sheet member defining a pair of spaced protrusions, the arcuate protrusion and the spaced protrusions together defining an arcuate cavity when the sheet members are nested together, the arcuate cavity being surrounded by the window in the elongated card and adapted to receive and display portions of the wristwatch through the window.

DRAWINGS

The invention, both as to organization and method of practice, together with further objects and advantages thereof, will best be understood with reference to the following description, taken in connection with the accompanying drawings, in which:

FIG. 1 is a plan view of a transparent plastic member comprising first and second elongated sheet members joined with an integral hinge, FIG. 2 is an elevational view in cross section, taken along lines II—II of FIG. 1, FIG. 3 is a plan view of a display card, FIG. 4 is a plan view of an assembled watch display package containing a wristwatch, and FIG. 5 is an elevational drawing in cross section, taken along lines IV—IV of FIG. 4.

DESCRIPTION OF THE PREFERRED EMBODIMENT

Figure 1:
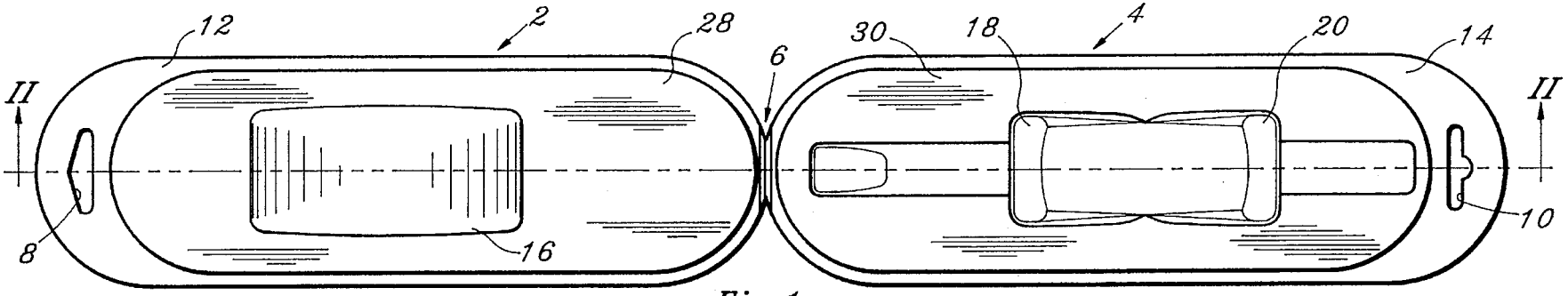
Figure 2:
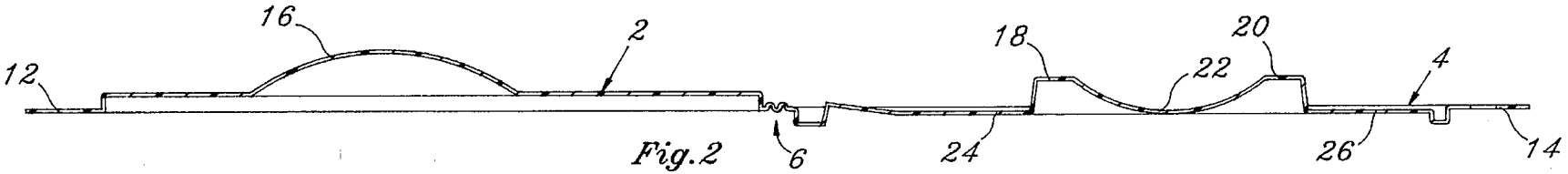

Referring now to FIG. 1 of the drawing, FIGS. 1 and 2 show plan view and cross sectional elevational view respectively of a single elongated member of transparent plastic material, comprising a first elongated sheet member 2 and a second elongated sheet member 4 joined end-to-end by a flexible integral hinge 6. Members 2 and 4 with hinge 6 are preferably vacuum formed from a larger blank of transparent plastic material in a vacuum mold, and then die cut in a second operation to provide the exterior shape shown, as well as a pair of cut out slots 8, 10 in opposite ends thereof. The vacuum forming mold is arranged to provide a peripheral flange 12 around the first elongated sheet member 2 and a similar peripheral flange 14 around the second elongated member 4. As best seen in the cross section view of FIG. 2, the forming operation further provides an arcuate protrusion 16 near the central part of the first elongated sheet member and a pair of spaced protrusions 18, 20 on the second elongated sheet member. Protrusions 18, 20 are connected by an arcuate wall 22 matching the curve of the arcuate protrusion 16 on the other sheet member.

The vacuum forming mold is further arranged to provide a longitudinal recess 24 conforming to the general shape of a watch strap buckle end and a longitudinal recess 26 conforming generally to the shape of a watch strap tongue end. The longitudinal recesses 24, 26 are optional, depending on how the watch is to be placed in the package.

Lastly, it should be noted that the surface of the first elongated sheet member 2 is connected with its peripheral flange 12 by a vertical peripheral wall 28. A similar peripheral wall 30 on the second peripheral sheet member 4 has the proper size and dimension to nest within peripheral wall 28 when the two members 2 and 4 are folded together, using hinge 6. The cutout slots 8, 10 are located so as to register with one another when the members 2 and 4 are folded, so as to provide a hole for hanging on a display rack hook.

Figure 3:
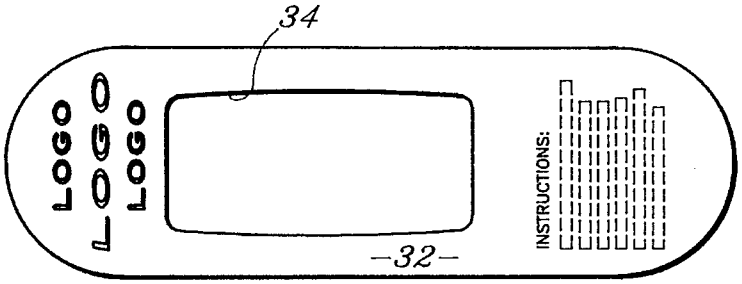

Reference to FIG. 3 shows an elongated display card 32 adapted to receive printed information thereon and having an exterior shape and dimension which will fit inside the peripheral wall 30 of the second member. Card 32 defines a rectangular window 34 corresponding substantially to the size and shape of the intersection of the arcuate protrusion 16 with the surface of member 2.

Figure 4:
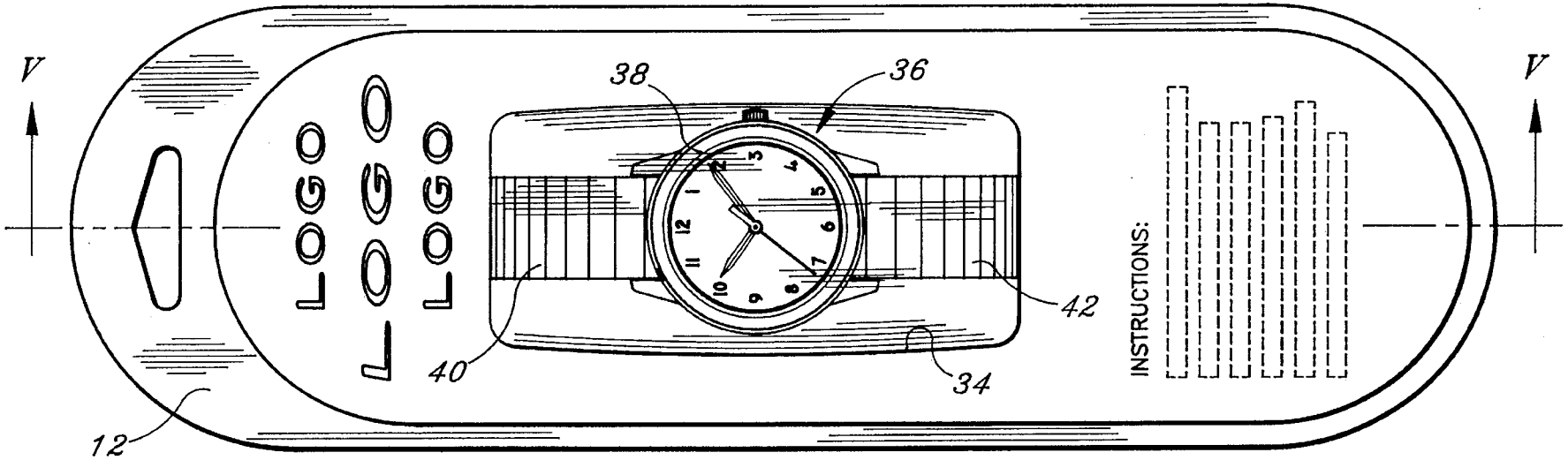
Figure 5:
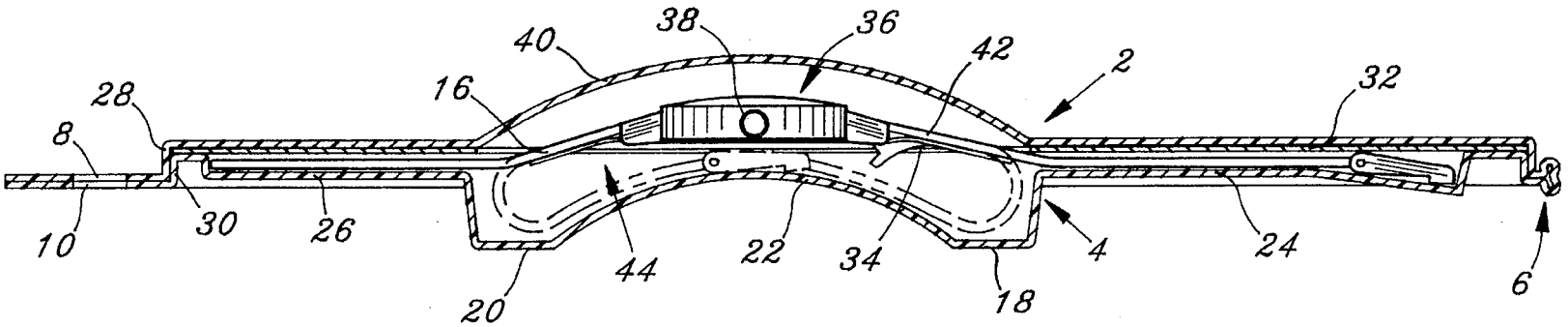

Referring now to FIGS. 4 and 5 of the drawing, the assembled watch display package is shown with a wristwatch 36 inside comprising a watch case 38, tongue portion 40 of a watch strap and buckle portion 42 of a watch strap. The second elongated member 4 has been folded under and inverted by virtue of the flexible hinge 6. The wristwatch 36 and the display card 32 are enclosed within the two nesting sheet members 2, 4 as shown. The arcuate protrusion 16 in the first sheet and the two spaced protrusions 18, 20 in the second sheet together define an arcuate cavity 44 containing portions of the wristwatch 36. The watch is shown in FIG. 5 with the strap ends extended in opposite directions in recesses 24, 26. However the strap ends may also be buckled and disposed in the arcuate cavity 44 as indicated by the phantom lines. After the watch package is assembled, it is preferably heat sealed in the vicinity of the peripheral walls 28, 30.

Referring to FIG. 4, it will be apparent that the walls making up the arcuate cavity 44 permit viewing the portions of the wristwatch through the aperture 34 in the display card. Both sides of the display card may also carry printing describing the wristwatch as well as other necessary information. If desired, leaflets or warranty cards may also be inserted in the package. The arcuate cavity is curved so that the watch may be held up around the wrist and viewed as through it were being worn on the wrist. If desired, the extending strap recesses 24, 26 may be eliminated, and the watch always arranged within the arcuate cavity as shown by the phantom lines in FIG. 4. The walls of the protrusions may be further shaped to position the watch to prevent side-to-side movement and to protect it during shipping.

The improved wristwatch display package offers many advantages. The package may be hung from a display rack by utilizing the matching cut out slots 8, 10. The arcuate portions of the display package nest with adjacent wristwatch display packages on the rack, enabling carrying many display packages on a single hook. Alternatively, the packages may be laid flat and displayed in a countertop case. They may be handed to a prospective purchaser who can hold them up adjacent the wrist. Since the arcuate cavity is curved to fit the wrist, the purchaser can view the watch through the window as though it were on the wrist, and also examine the front and back of the display card through the transparent plastic packaging.

The elongated sheet members of transparent plastic are preferably vacuum molded, but may also be formed by other suitable processes, such as injection molding.

While there is shown what is considered to be the preferred embodiment of the invention, other modifications will occur to those skilled in the art, and it is desired to secure in the appended claims all such modifications as fall within the true spirit and scope of the invention.

We claim:

1. An improved wristwatch display package comprising first and second elongated sheet members of transparent plastic adapted to be nested together around the peripheral edges thereof, an elongated display card having printing thereon disposed between said sheet members and within the nested peripheral edges, said card defining a window for displaying a portion of a wristwatch through the transparent plastic, said first sheet member defining an arcuate elongated protrusion, and second sheet member defining a pair of spaced protrusions which protrude in a direction opposite that of said arcuate protrusion when the elongated sheet members are so nested, said arcuate protrusion and said pair of spaced protrusions together defining an arcuate cavity, said arcuate cavity traversing and extending both above and below the nested elongated sheet members, said arcuate cavity being surrounded by said window in said elongated display card and adapted to receive and display portions of a wristwatch through said window.

2. The package according to claim 1, wherein said first and second elongated sheet members are joined together end-to-end by a flexible integral hinge.

3. The package according to claim 2, wherein each of said elongated sheet members includes a peripheral flange, said flanges being joined by said flexible integral hinge, said flanges each defining a cutout slot in the ends thereof opposite said hinge, said cutout slots adapted to register with one another when the sheet members are nested.

4. The package according to claim 1, wherein said nested peripheral edges are sealed around the periphery of said package.

5. The package according to claim 1, wherein at least one of said sheet members further defines a longitudinal recess joining said arcuate cavity and adapted to receive a watch strap portion.

* * * * *